United States Patent [19]

Economakis

[11] 4,205,802

[45] Jun. 3, 1980

[54] MULTIPLE ROLL TOILET TISSUE DISPENSER

[76] Inventor: Elias Economakis, 62 Centre St., Brookline, Mass. 02146

[21] Appl. No.: 45,018

[22] Filed: Jun. 4, 1979

[51] Int. Cl.[2] ..... A47K 10/22

[52] U.S. Cl. ..... 242/55.3

[58] Field of Search ..... 242/55.3, 55.53, 55.2, 242/55.42; 312/39, 40, 41

[56] References Cited

U.S. PATENT DOCUMENTS

| | | | |
|---|---|---|---|
| 2,386,408 | 10/1945 | Schiff | 242/55.3 |
| 2,790,608 | 4/1957 | Sieven | 242/55.3 |
| 2,872,124 | 2/1959 | Sieven | 242/55.3 |
| 3,428,267 | 2/1969 | Briles | 242/55.53 |

*Primary Examiner*—George F. Mautz

*Attorney, Agent, or Firm*—Herbert L. Gatewood

[57] ABSTRACT

A toilet tissue dispenser is provided for storing a plurality of rolls of toilet tissue in vertically disposed compartments, and dispensing tissue from either of the rolls as desired. The toilet tissue dispenser provides convenient, multiple rolls of toilet tissue. A dispenser in accordance with the invention can be used in existing toilet tissue dispensing wells commonly found in the home and installed without need for any additional fixtures or tools.

6 Claims, 3 Drawing Figures

MULTIPLE ROLL TOILET TISSUE DISPENSER

BACKGROUND OF THE INVENTION (1) Field of the Invention

This invention relates to a means for dispensing toilet tissue, in particular a multiple roll toilet tissue dispenser, for use in holding and storing multiple rolls of toilet tissue, tissue from each roll being dispensed as desired, and to the particular manner of construction of the multiple roll toilet tissue dispenser.

(2) Description of The Prior Art

An empty roll of toilet tissue can be not only a source of embarrassment, but also an inconvenience. In recognition of this problem, the single roll dispensers have sometimes been installed by institutions, e.g., office buildings, theaters, service stations, etc., in side-by-side relationship, so that a spare roll of toilet tissue will be readily available for use when, and if, needed. Oftentimes this has been found unsatisfactory, however, because tissue from each of the rolls is available simultaneously for use, and tissue is wasted by some users.

There have been developed over the years a variety of dispensers which hold and store a multiplicity of rolls of toilet tissue. With one such dispenser, only one roll of tissue is made available for use at a time, while another roll is held as a spare. Access to the spare roll requires a key, however, and a new roll of tissue is provided only when the janitorial service or the like makes it available. This being the case, the need for the spare roll of tissue often occurs before it becomes available.

Another toilet tissue dispenser of which I am aware, and which does meet the above-problem, does provide two vertically disposed rolls, and tissue can be used from either roll, as desired. The used rolls of tissue in this case are replaced by the janitorial service, as needed; however, access to the roll compartments is generally only by means of a special key which fits the dispenser cabinet.

The embarrassment and inconvenience of an empty roll of toilet tissue is not limited to institutions. It is experienced in the home, as well. However, all of the multiple roll dispensers of which I am aware are suitable primarily for institutional usage. These dispensers have a flat planar back member and must be mounted on a flat planar wall. None of them, of which I am aware, can be used in combination with the wall recess, or well, conventionally provided for rolls of toilet tissue in the home. Nevertheless, no one to my knowledge has ever suggested mounting dual side-by-side single roll dispensers or the multiple roll dispensers for residential usage. When the tissue roll in the home dispenser is empty, a new roll of tissue must be obtained from wherever these rolls are stored in anticipation of usage. Oftentimes, however, additional rolls of toilet tissue are not stored in a place that is convenient when needed.

While the problem resulting from an empty toilet tissue roll is often annoying in the case of a single bathroom home, it can be even more bothersome when there are two or more toilet facilities in the home. This is particularly the case when the toilet facilities are located at a remote distance from the storage cabinet used for spare rolls of tissue, such as may well be the case in a multi-floor dwelling.

Those confronted with the inconvenience of an empty roll of toilet tissue are oftentimes older persons, or persons physically incapacitated. In these cases, it is often most difficult for such a person to obtain a new roll of toilet tissue, no matter how close by the spare rolls may be stored.

Bathroom walls in the home are usually, at least in the lower half, of a decorative tile, and the more common toilet roll dispenser in such a case is a tile fixture. This fixture comprises, in general, two spaced apart projections, protruding outwardly somewhat from the wall, and an arcuate recess between the two projections projecting inwardly of the wall. Each projection is provided on its internal surface with a dead bore for holding a spring loaded spindle or shaft for rotatably mounting the roll of toilet tissue. The cylindrical shape of the toilet tissue roll conforms to that of the arcuate recess and the recess provides a well in which a portion of the roll of tissue rotates as the tissue is dispensed.

None of the multiple roll toilet tissue dispensers of which I am aware are of a satisfactory construction for use in a home toilet. In particular, their construction makes them incompatible with the existing tile dispenser fixture. For such a multiple roll dispenseer to be used at all in the home would require their separate installation, adjacent the existing tile fixture. While this would provide the desired multiple rolls of tissue, it would present a most undesirable appearance. More than likely, it would also leave the tile dispenser unused. The tile dispenser could, of course, be removed from the wall and the multiple roll dispenser installed in its place. However, this would required considerable effort in installation. Wall tiles are sometimes quite difficult to remove, and surrounding tiles are sometimes accidentally chipped and cracked in the effort. In any event, holes must be drilled in the tile, lead screw anchors or the like placed in the holes, and mounting screws then screwed into place. Moreover, the dispenser must necessarily be wider than the width of the tile dispenser removed, to provide complete coverage of the now existing opening. However, this may require some modification of the internals of the present multi-roll dispensers.

SUMMARY OF THE INVENTION

There is provided in accordance with my invention a means for dispensing toilet tissue from a plurality of different rolls of tissue, particularly suitable for use in the home, not attendant with the problems and disadvantages set forth above.

The multiple roll toilet tissue dispenser of the invention, in its most basic aspects, comprises a plurality of vertically disposed compartments, each for holding and storing a single roll of toilet tissue, and making it available for use as desired, each compartment comprising two spaced apart side members, means being provided in each compartment for rotatably mounting a roll of toilet tissue, a back member joining together the side members of each compartment, one of which back members is of an arcuate cross-sectional shape bowed outwardly and conforming to the arcuate cross-sectional shape of the well in a conventional tile dispenser, the other back members being in the same vertical plane, whereby in use the multiple roll toilet tissue dispenser of the invention is of such conforming construction as to be compatibly associated in combination with the already existing tile dispenser and laying flush against and in contact with the tiled wall surface or the like of the bathroom.

The more preferred multiple roll toilet tissue dispenser according to the invention is a three roll dispenser comprising a middle compartment and compartments disposed vertically above and below the middle compartment, each compartment comprising two spaced apart side members and means therein for rotatably mounting a single roll of toilet tissue, a planar backing member on each said compartment above and below the middle compartment connecting together the spaced apart members, and located in the same vertical plane, a member of arcuate cross-section bowed outwardly form the dispenser body joining together the side members of the middle compartment, said member of arcuate cross-section being of a conforming shape to an arcuate-shaped recess in an already existing wall tile toilet roll dispenser whereby on installation of the dispenser of the invention, the back members of the upper and lower compartment are flush against the wall surface.

In a still more preferred aspect of the invention, one of the side members in each upper and lower compartment is hingedly connected to the back member, facilitating mounting of a new roll of tissue as and when needed.

Quite advantageously, the multiple roll toilet tissue dispenser of the invention can be installed simply and without use of any tools. Its installation makes use of the already existing tile dispenser, and the spindle use with it for conventionally holding and mounting a roll of toilet tissue. The installation of the dispenser of the invention in combination with the existing tile fixture is only slightly more complicated than installing a single roll of toilet tissue, as is conventionally done.

Installation is accomplished without need for drilling into the wall structure, and requires no mounting screws or the like. As there is no drilling, there is no mess associated with its installation.

As all rolls of toilet tissue are available for use, and are visible, the dispenser of the invention makes it possible, if desired, to use a variety of different decorative rolls of tissue.

BRIEF DESCRIPTION OF THE DRAWING

The invention is described in greater detail hereinafter by reference to the drawing, in which.

DETAILED DESCRIPTION OF THE INVENTION AND THE PREFERRED EMBODIMENTS

Figure 1:
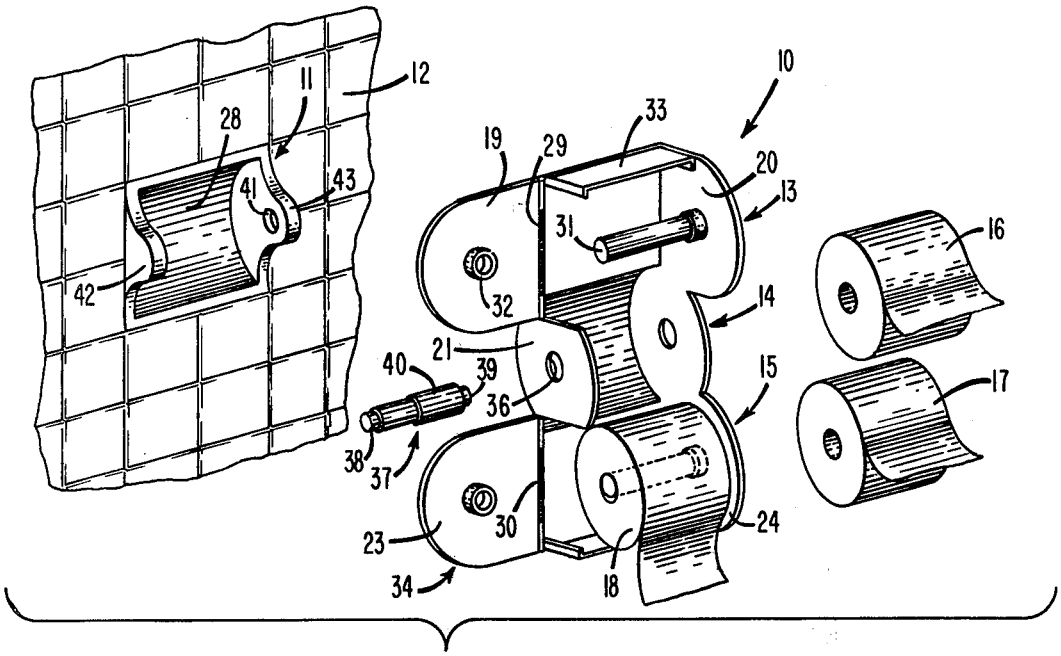
FIG. 1 shows an exploded view in perspective, showing a multiple roll toilet tissue dispenser according to the invention to be mounted in combination with a conventional already existing tile fixture dispenser.

Turning now to the drawing there is shown in FIG. 1 thereof a multiple roll toilet tissue dispenser 10 in accordance with the invention for mounting in combination with a tile fixture dispenser 11 conventionally found mounted on the wall 12 in the usual home bathroom.

Multiple roll dispenser 10 comprises, as shown in the drawing, a plurality of individual vertically disposed compartments 13, 14 and 15 for holding and storing a plurality of rolls 16, 17 and 18 of toilet tissue.

Each compartment comprises two spaced-apart side members, as identified by reference numerals 19, 20; 21, 22; and 23, 24. These side members are maintained in their desired spaced-apart relationship, to accommodate the width of the usual roll of toilet tissue, and are fastened together by means of back members 25, 26, and 27.

It will be appreciated, however, that back members 25, 26, and 27 can be fastened by any means desired to their respective side members, for example, adhesive, soldering, rivets, etc. The back members and side members can even be of one integral piece of a suitable material of construction, e.g., plastic, metal, plastic coated metal, etc., the unitary construction being provided in the desired final shape during manufacture.

As shown in the drawing, back members 25 and 27 are of planar configuration and lie in the same vertical plane, equidistantly on either side of middle compartment 14. Back member 26, however, is of arcuate cross-section, bowing outwardly as shown, and conforming to the size and shape of arcuate-shaped recess or well 28 in the conventional dispenser fixture 11 of wall tile. Thus, when installed, the back members 25 and 27 will fit flush against wall surface 12.

Figure 2:
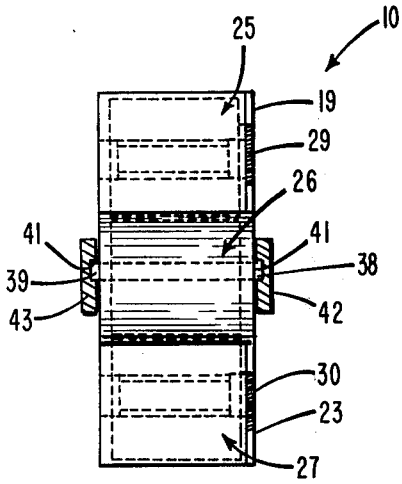
FIG. 2 is a rear view of the multiple roll dispenser shown in FIG. 1.
Figure 3:
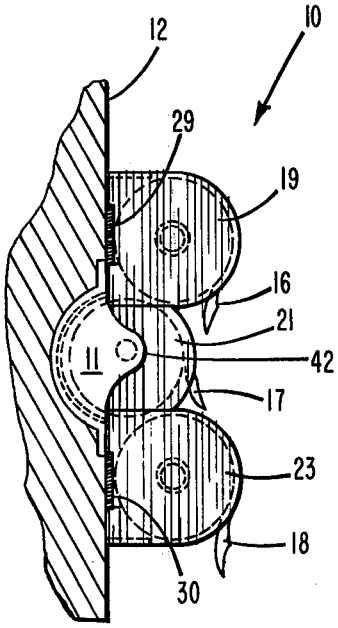
FIG. 3 is a side view showing the multiple roll dispenser in FIG. 1 installed for use, the side mebers on the one side being removed, to show more clearly the three separate compartments of the dispenser.

The back members 25, 26 and 27 as will be appreciated, can be of lattice configuration of the like, if desired, and need not be of the construction shown in FIG. 2 of the drawing. The main consideration in their construction is that some configuration of back member must be provided to connect the side members of each compartment to each other.

The side members 19, 23 of the compartments 13, 15, as shown in the drawing, are hingedly mounted to their respective back members 25, 27, thus facilitating placing a roll of toilet tissue in these compartments, and the removal of an empty roll. However, it will be appreciated that this need not necessarily be the case. These side members can be in fixed position, with respect to their respective back members, as are side members 20 and 24. In this case, the three side members on each side of the dispenser 10 can be of unitary construction, thus facilitating and simplifying manufacture.

Maintaining side members 19 and 23 in the desired closed position is facilitated by conventional spring members 29, 30 respectively. Thus, side member 19 is always urged to a closed position against the end of spindle 31 which supports the roll of toilet tissue 16. On the inside of the surfaces of the side members 19, 20 and 23, 24 are provided dead bore mounting means such as identified by reference numeral 32. These dead bores accommodate the ends of the spindles, e.g., spindle 31, as is conventional, for supporting the spindle and rotatably mounting the rolls of toilet tissue 16, 18. It will be appreciated, however, that instead of dead bores, circular openings can be provided in these side members, in which case the ends of the spindles will slightly protrude. The particular manner of supporting the spindles is of no particular consequence except that from an aesthetic view point, the dead bores are more preferred.

The top and bottom of dispenser 10 are covered somewhat by top member 33 and bottom member 34, which are connected to side members 20, 24, respectively. These members can cover more or less of the top and bottom rolls of toilet tissue, as desired. Depending vertically downwardly from the one end of top member 33 is provided a flange 35 which functions as a stop means for hinged side member 19. A similar stop means, as shown in FIG. 1 is provided on bottom member 34.

The side members 21, 22 of middle compartment 14 are fixedly connected to arcuate-shaped back member 26. These side members each are provided with a circular opening such as shown by reference numerals 36' through which protrude respectively ends 38, 39 of the spindle 37. Ends 38, 39 of the spindle, as is usual, are spring loaded and can move axially a predetermined distance into the cylindrical shaped body 40 of the spindle. Spindle 37 conventionally fits into dead bores such as identified by reference numeral 41 provided in the spaced-apart projections 42, 43 of dispenser fixture 11 which project outwardly from wall surface 12.

To install multiple roll dispenser 10, according to my invention, in combination with dispenser fixture 11, one must first remove the spindle 37 from dispenser fixture 11. The middle compartment 14 of the dispenser 10 is then located in well 28 between projections 42, 43. Spindle 37 meanwhile has been inserted in usual fashion in the open cylindrical shaped roll of the usual roll of toilet paper 17. Roll 17 is then placed in its compartment 14, while depressing the ends 38, 39 of spindle 37. These ends, on being aligned with the circular shaped openings provided in the side members 21, 22 spring outwardly and intrude into the dead circular bores provided in projections 42, 43. Thus, dispenser 10 is made fast against the wall 12 and is ready for placement of rolls of tissue 16, 18 in their respective compartments.

Multiple roll dispenser 10, as earlier mentioned, can be manufactured of various materials. When manufactured of plastic, e.g., vinyl chloride compositions, polyethylene, polypropylene, ABS, etc., conventional molding techniques can be utilized. The dispenser can be provided of various decorative colors, as desired. The entire body member of the dispenser, except for the hinged side mebers can be manufactured of unitary construction. The hinged side members can be formed and later assembled with the rest of the body member of the dispenser, at the same time providing the spring loading, if desired.

When the multiple roll dispenser is manufactured of a suitable plastic material, the outside surfaces of the side members of the upper and lower compartments can be quite easily provided with decorative surfaces, these need not be planar as shown in the drawing. These decorative surfaces can be quite readily provided in the manufacturing process, e.g., injection molding, and can take various forms. For example, raised floral patterns can be provided, or abstract designs.

The body member of the dispenser can be stamped, or otherwise formed, from a suitable metal and later decorated, for example, by spray painting. Or various decorative decals can be provided on the surface of the side member. Conventional forming techniques can be used in the formation of the body member from metal.

The hinged side members can be, if desired, detachably fastened to the respective bottom and top members. This can be accomplished by conventional magnetic fastening means, or hook and eye fasteners. Snap type fasteners can also be used for this purpose.

The particular cross-sectional configuration where the upper and lower back members meet the back member of the middle compartment of the dispenser may need be modified somewhat from that actually shown in the drawing. A notched, rectangular area may need by provided in some cases where the upper and lower edges of the tile fixture protrude outwardly from the wall, to make the back members of the upper and lower compartments lie flush with the wall surface.

As many different embodiments of this invention will now occur to those skilled in the art, it is to be understood that the specific embodiments of the invention as presented herein are intended by way of illustration only and are not limiting on the invention, but that the limitations thereon can be determined only from the appended claims.

What I claim is:

1. Means for dispensing toilet tissue as desired from a plurality of different rolls of tissue comprising a body member comprising a plurality of vertically disposed compartments for storage of a plurality of rolls of tissue, each said compartment comprising two spaced-apart side members, and a backing member joining the side members together, means provided in each said compartment for rotatably supporting a spindle for a single roll of tissue and providing it ready for use as and when needed, the backing member of one of said compartments being of arcuate shape and the backing member of the other compartments being planar and extending in the same vertical plane.

2. Means for dispensing toilet tissue as desired from a plurality of different rolls of tissue according to claim 1 wherein the dispensing means comprises a middle compartment and a compartment above and below the middle compartment, the backing member of the middle compartment being of arcuate shape in cross-section.

3. Means for dispensing toilet tissue as desired from a plurality of different rolls of tissue according to claim 2 wherein the side members on the same side of the upper and lower compartments are hingedly mounted in association with their respective backing member.

4. Means for dispensing toilet tissue as desired from a plurality of different rolls of tissue according to claim 3 wherein the side members on the other side of the dispenser are of unitary construction.

5. Means for dispensing toilet tissue as desired from a plurality of different rolls of tissue according to claim 4 wherein the body member is of unitary construction.

6. Means for dispensing toilet tissue as desired from a plurality of different rolls of tissue according to claim 5 wherein the dispensing means is of a suitable plastic material.

* * * * *